US011636814B2

(12) United States Patent
Slavenburg

(10) Patent No.: US 11,636,814 B2
(45) Date of Patent: Apr. 25, 2023

(54) TECHNIQUES FOR IMPROVING THE COLOR ACCURACY OF LIGHT-EMITTING DIODES IN BACKLIT LIQUID-CRYSTAL DISPLAYS

(71) Applicant: NVIDIA Corporation, Santa Clara, CA (US)

(72) Inventor: Gerrit Slavenburg, Hayward, CA (US)

(73) Assignee: NVIDIA Corporation, Santa Clara, CA (US)

( * ) Notice: Subject to any disclaimer, the term of this patent is extended or adjusted under 35 U.S.C. 154(b) by 0 days.

(21) Appl. No.: 16/163,516

(22) Filed: Oct. 17, 2018

(65) Prior Publication Data

US 2019/0266960 A1 Aug. 29, 2019

Related U.S. Application Data

(60) Provisional application No. 62/636,126, filed on Feb. 27, 2018.

(51) Int. Cl.
*G09G 3/34* (2006.01)
*G09G 3/36* (2006.01)

(52) U.S. Cl.
CPC ..... *G09G 3/3413* (2013.01); *G09G 3/342* (2013.01); *G09G 3/36* (2013.01); *G09G 2320/062* (2013.01); *G09G 2320/0666* (2013.01)

(58) Field of Classification Search
CPC ..... G09G 3/3413; G09G 3/342; G09G 3/36; G09G 2320/0666
USPC ..... 345/694
See application file for complete search history.

(56) References Cited

U.S. PATENT DOCUMENTS

| | | | | |
|---|---|---|---|---|
| 5,931,960 | A | 8/1999 | Kletter | |
| 6,359,662 | B1 * | 3/2002 | Walker | G09G 3/34 348/615 |
| 6,633,301 | B1 | 10/2003 | Dallas et al. | |
| 7,843,402 | B2 | 11/2010 | Nakadaira | |
| 8,059,070 | B2 | 11/2011 | Odawara | |
| 11,295,679 | B2 | 4/2022 | Lee | |
| 2002/0019970 | A1 | 2/2002 | Araki et al. | |
| 2002/0145685 | A1 | 10/2002 | Mueller-Mach et al. | |
| 2005/0073495 | A1 | 4/2005 | Harbers et al. | |

(Continued)

OTHER PUBLICATIONS

Ex-Parte Quayle Action received for U.S. Appl. No. 16/276,564, dated Mar. 31, 2020, 16 pages.

(Continued)

*Primary Examiner* — Chanh D Nguyen
*Assistant Examiner* — Ngan T. Pham-Lu
(74) *Attorney, Agent, or Firm* — Artegis Law Group, LLP

(57) ABSTRACT

A display device includes an array of LEDs, an array of LCD pixels, and a display controller. The display controller is configured to compensate for one or more sources of color variation in light produced by the LEDs. The display controller can determine a first color variation at a given LCD pixel based on the distance between the given LCD pixel and one or more LEDs. The display controller can also determine a second color variation at the given LCD pixel based on a current level supplied to the one or more LEDs. The display controller configures the given LCD pixel to filter light that is received from the one or more LEDs in a manner that reduces or eliminates either or both of the first and second color variations.

18 Claims, 10 Drawing Sheets

(56) References Cited

U.S. PATENT DOCUMENTS

| | | | | |
|---|---|---|---|---|
| 2005/0073845 | A1 | 4/2005 | Matsui | |
| 2006/0077489 | A1 | 4/2006 | Zhang et al. | |
| 2006/0107616 | A1 | 5/2006 | Ratti et al. | |
| 2006/0279522 | A1 | 12/2006 | Kurihara | |
| 2007/0027651 | A1* | 2/2007 | Ng | H04N 9/67 702/116 |
| 2007/0211014 | A1 | 9/2007 | Kim et al. | |
| 2007/0268695 | A1* | 11/2007 | Seetzen | G09G 3/3413 362/231 |
| 2009/0033612 | A1 | 2/2009 | Roberts et al. | |
| 2009/0174638 | A1* | 7/2009 | Brown Elliott | G09G 3/2011 345/88 |
| 2010/0110112 | A1 | 5/2010 | Nakanishi | |
| 2010/0134406 | A1 | 6/2010 | Maruyama et al. | |
| 2010/0134512 | A1* | 6/2010 | Kwon | G09G 3/3426 345/589 |
| 2010/0171690 | A1* | 7/2010 | Park | G09G 3/3413 345/102 |
| 2010/0225574 | A1 | 9/2010 | Fujiwara | |
| 2010/0253706 | A1 | 10/2010 | Shirouzu | |
| 2010/0295879 | A1 | 11/2010 | Tanaka et al. | |
| 2010/0315445 | A1 | 12/2010 | An et al. | |
| 2010/0315446 | A1 | 12/2010 | An et al. | |
| 2011/0050760 | A1 | 3/2011 | Ito et al. | |
| 2011/0069095 | A1 | 3/2011 | Kim et al. | |
| 2011/0096249 | A1* | 4/2011 | Belik | G09G 3/3413 348/791 |
| 2011/0122170 | A1* | 5/2011 | Kim | G09G 3/3406 345/690 |
| 2011/0141077 | A1 | 6/2011 | Cho | |
| 2011/0193896 | A1 | 8/2011 | Johnson | |
| 2011/0205259 | A1 | 8/2011 | Hagood, IV | |
| 2012/0051635 | A1 | 3/2012 | Kunkel et al. | |
| 2012/0075555 | A1 | 3/2012 | Parker et al. | |
| 2012/0093430 | A1 | 4/2012 | Sumi et al. | |
| 2012/0105509 | A1 | 5/2012 | Ito | |
| 2012/0154459 | A1 | 6/2012 | Otoi | |
| 2012/0154462 | A1 | 6/2012 | Hempson et al. | |
| 2013/0010016 | A1 | 1/2013 | Sasaki | |
| 2013/0314459 | A1 | 11/2013 | Nakanishi | |
| 2014/0327710 | A1 | 11/2014 | Xu et al. | |
| 2015/0070403 | A1 | 3/2015 | Kim | |
| 2015/0116378 | A1 | 4/2015 | Cho et al. | |
| 2016/0225301 | A1* | 8/2016 | Scepanovic | G09G 3/32 |
| 2016/0344992 | A1* | 11/2016 | D'Alfonso | A61B 1/00006 |
| 2017/0132972 | A1 | 5/2017 | Tsuchida | |
| 2017/0223786 | A1 | 8/2017 | Petluri et al. | |
| 2018/0145116 | A1* | 5/2018 | Lee | G09G 3/3413 |
| 2018/0277059 | A1 | 9/2018 | Tomabechi | |
| 2018/0302651 | A1 | 10/2018 | Jacobson et al. | |
| 2018/0336397 | A1* | 11/2018 | Smith | G06K 9/00288 |
| 2019/0107626 | A1 | 4/2019 | Marsuura | |
| 2019/0188917 | A1 | 6/2019 | Cho | |
| 2019/0266935 | A1 | 8/2019 | Roever | |
| 2019/0266959 | A1 | 8/2019 | Slavenburg | |
| 2019/0266961 | A1 | 8/2019 | Slavenburg | |

OTHER PUBLICATIONS

Non-Final Office Action received for U.S. Appl. No. 16/268,438, dated Mar. 30, 2020, 20 pages.
Notice of Allowance for U.S. Appl. No. 16/152,358, dated Nov. 20, 2019, 12 pages.
Non-Final Office Action received for U.S. Appl. No. 16/271,743, dated Jun. 22, 2020, 31 pages.
Non-Final Office Action received for U.S. Appl. No. 16/271,743 dated Jun. 22, 2020, 36 pages.
Notice of Allowance received for U.S. Appl. No. 16/271,744, dated Mar. 17, 2020, 28 pages.
Non-Final Office Action received for U.S. Appl. No. 16/163,515, dated Mar. 3, 2020, 40 pages.
Notice of Allowance received for U.S. Appl. No. 16/276,564, dated Jul. 7, 2020, 46 pages.
Non-Final Office Action issued in U.S. Appl. No. 16/271,743 dated Feb. 19, 2021, 21 pages.
Non-Final Office Action received for U.S. Appl. No. 16/828,850, dated Nov. 24, 2020, 38 pages.
Final Office Action received for U.S. Appl. No. 16/271,743 dated Oct. 14, 2020, 29 pages.
Final Office Action received for U.S. Appl. No. 16/271,743 dated Jun. 30, 2021, 32 pages.
Final Office Action received for U.S. Appl. No. 16/163,515, dated Aug. 28, 2020, 37 pages.
Non-Final Office Action received for U.S. Appl. No. 16/163,515, dated May 25, 2021, 49 pages.
Notice of Allowance received for U.S. Appl. No. 16/276,564, dated Sep. 23, 2020, 5 pages.
Final Office Action received for U.S. Appl. No. 16/268,438 dated Sep. 9, 2020, 24 pages.
Notice of Allowance received for U.S. Appl. No. 16/828,850, dated Mar. 19, 2021, 16 pages.
Notice of Allowance received for U.S. Appl. No. 16/268,438 dated Jan. 1, 2021, 34 pages.
Notice of Allowance received for U.S. Appl. No. 16/268,438 dated Feb. 18, 2021, 18 pages.
Notice of Allowance received for U.S. Appl. No. 16/276,564, dated Nov. 12, 2020, 6 pages.
Final Office Action received for U.S. Appl. No. 16/163,515 dated Dec. 7 , 2021, 26 pages.
Notice of Allowance received for U.S. Appl. No. 16/271,743 dated Sep. 17, 2021, 14 pages.
Advisory Action received for U.S. Appl. No. 16/163,515, dated Feb. 18, 2022, 4 pages.
Non Final Office Action received for U.S. Appl. No. 16/163,515 dated May 24, 2022, 12 pages.
Smith et al., "Transactions of the Optical Society", DOI: 10.1088/1475-4878/33/3/301, vol. 33, No. 3, 1931, pp. 73-134.

* cited by examiner

TECHNIQUES FOR IMPROVING THE COLOR ACCURACY OF LIGHT-EMITTING DIODES IN BACKLIT LIQUID-CRYSTAL DISPLAYS

CROSS-REFERENCE TO RELATED APPLICATIONS

This application claims the priority benefit of United States provisional patent application titled, "Color Correction Method for Change of LED Backlight Color," filed on Feb. 27, 2018 and having Ser. No. 62/636,126. The subject matter of this related application is hereby incorporated herein by reference.

BACKGROUND

Field of the Various Embodiments

Embodiments of the present invention relate generally to display devices and display technology and, more specifically, to techniques for improving the color accuracy of light-emitting diodes in backlit liquid-crystal displays.

Description of the Related Art

A conventional liquid-crystal display (LCD) usually includes an array of light-emitting diodes (LEDs) coupled to an array of LCD pixels. The array of LEDs is commonly known as the "backlight." In operation, the backlight emits light to the array of LCD pixels with a brightness that can vary across different LCD pixels. A given LCD pixel includes a set of filters that modifies the color of the light received from the backlight in order to emit light having a specific color value.

In a typical system, a display controller coordinates the operations of the backlight and the array of LCD pixels to cause an image to be displayed via the LCD. In so doing, the display controller determines the brightness of each LED included in the backlight based on the image to be displayed and then sets the current supplied to each LED to achieve the determined brightness. The display controller also configures each LCD pixel to emit light having a color value that represents a specific portion or pixel of the image being displayed. To configure a given LCD pixel to emit light having a specific color value, the display controller first estimates the total intensity of light received at the given LCD pixel from some or all LEDs included in the backlight. The display controller then divides the desired color value by that total intensity to produce percentages of red, green, and blue light the given LCD pixel should filter when displaying the image. Finally, the display controller configures the given LCD pixel according to these percentages.

The above approach, which is implemented by many conventional display controllers, suffers from at least two problems. First, the color of light received at a given LCD pixel from a given LED can vary based on the distance between the given LCD pixel and the given LED. In practice, LCD pixels often receive bluish light from nearby LEDs and yellowish light from more distant LEDs. Conventional display controllers do not account for these color variations when configuring the LCD pixels. Accordingly, the color of light emitted by a given LCD pixel can be inconsistent with the corresponding portion or pixel of the image being displayed. Second, the color of light emitted by a given LED can vary based on the current supplied to the given LED. In practice, LEDs supplied with lower currents typically produce bluish light, while LEDs supplied with higher currents produce more yellowish light. Conventional display controllers also do not account for these color variations when configuring the LCD pixels. Accordingly, the color of light emitted by a given LCD pixel can be inconsistent with the corresponding portion or pixel of the image being displayed.

These two problems can occur separately or simultaneously in conventional LCDs during operation, especially in high dynamic range (HDR) LCDs. As a result, conventional HDR LCDs have trouble faithfully representing an image being displayed because the LCD pixels in a conventional HDR LCD do not accurately represent the colors within that image. This deficiency can substantially diminish the user experience because images displayed with inaccurate colors are oftentimes perceived as being unrealistic.

As the foregoing illustrates, what is needed in the art are more effective techniques for computing color values when configuring LCD pixels to display an image.

SUMMARY

Various embodiments include a computer-implemented method for configuring a plurality of screen pixels to display an image, including determining a first current level to be supplied to a first light source based on a first image, determining a first color value associated with a first portion of the first image, determining a first screen pixel responsible for displaying at least part of the first portion of the first image, determining, based on the first current level, a second color value associated with light that is contributed to the first screen pixel by the first light source, and configuring the first screen pixel to output light having the first color value based on a function of the first color value and the second color value.

At least one advantage of the disclosed techniques is that color variations that depend on current supplied to LEDs can be reduced or eliminated, thereby allowing the associated LCD pixels to more accurately emit light having a specific color.

BRIEF DESCRIPTION OF THE DRAWINGS

So that the manner in which the above recited features of the various embodiments can be understood in detail, a more particular description of the inventive concepts, briefly summarized above, may be had by reference to various embodiments, some of which are illustrated in the appended drawings. It is to be noted, however, that the appended drawings illustrate only typical embodiments of the inventive concepts and are therefore not to be considered limiting of scope in any way, and that there are other equally effective embodiments.

DETAILED DESCRIPTION

In the following description, numerous specific details are set forth to provide a more thorough understanding of the various embodiments. However, it will be apparent to one skilled in the art that the inventive concepts may be practiced without one or more of these specific details.

As noted above, in a conventional LCD, the color of light received by a given LCD pixel from a given LED changes as a function of the distance between the given LCD pixel and the given LED. In addition, the color of light emitted by a given LED changes as a function of the current supplied to the given LED. Accordingly, the light received at any given LCD pixel from one or more LEDs included in the backlight typically has a varying color. The display controller included in a conventional LCD does not account for these color variations when configuring the LCD pixels to output specific color values, leading to images that are displayed with inaccurate colors.

To address these issues, embodiments of the invention include a display device that includes an array of LEDs, an array of LCD pixels, and a display controller. The display controller is configured to compensate for one or more sources of color variation in light produced by the LEDs. The display controller can determine a first color variation at a given LCD pixel based on the distance between the given LCD pixel and one or more LEDs. The display controller can determine a second color variation at the given LCD pixel based on a current level supplied to the one or more LEDs. The display controller configures the given LCD pixel to filter light that is received from the one or more LEDs in a manner that reduces or eliminates either or both of the first and second color variations. The display controller configures each LCD pixel to cause the array of LCD pixels to display an image with accurate colors.

At least one advantage of the disclosed techniques is that color variations that depend on the distances between LCD pixels and LEDs can be reduced or eliminated, thereby allowing the LCD pixels to more accurately emit light having a specific color. Another advantage of the disclosed techniques is that color variations that depend on the current levels supplied to LEDs can be reduced or eliminated, thereby allowing the LCD pixels to more accurately emit light having a specific color. Reducing color variations introduced by LED backlights improves the accuracy with which images can be displayed, thereby leading to an improved user experience. Accordingly, the disclosed techniques represent multiple advancements over prior art systems that do not compensate for any of the above color variations.

System Overview

Figure 1:
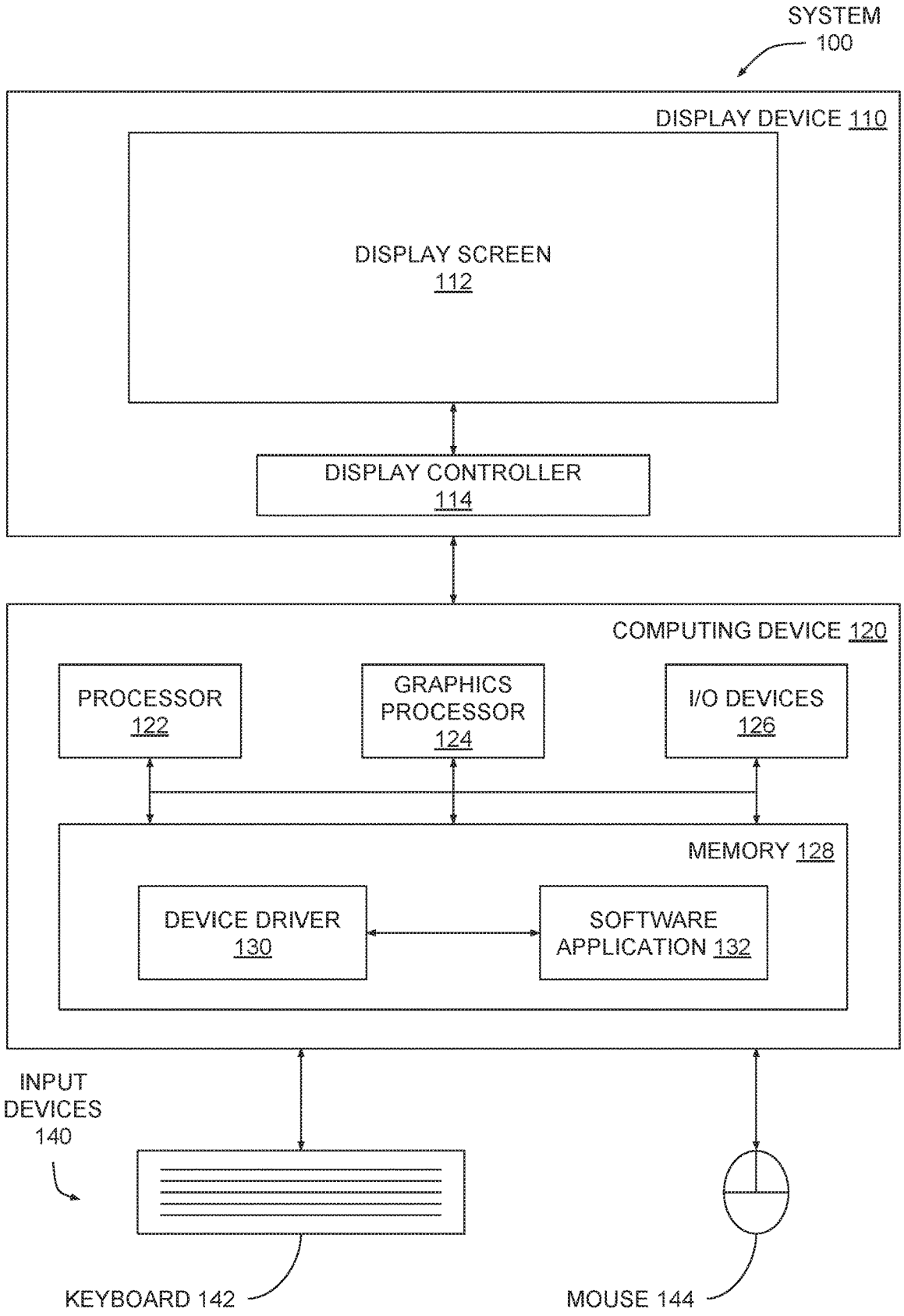
FIG. 1 illustrates a system configured to implement one or more aspects of the present invention.

FIG. 1 illustrates a system configured to implement one or more aspects of the present invention. As shown, system 100 includes a display device 110 coupled to a computing device 120. Computing device 120 is coupled to input devices 140 that include a keyboard 142 and a mouse 144. Display device 110 includes a display screen 112 and a display controller 114. In one embodiment, display device 110 is an LCD with an LED backlight configured for high dynamic range (HDR) output. Display device 110 is described in greater detail below in conjunction with FIGS. 2-10.

Computing device 120 includes a processor 122, a graphics processor 124, input/output (I/O) devices 126, and memory 128, coupled together. Processor 122 includes any technically feasible set of hardware units configured to process data and execute software applications. For example, processor 122 could include one or more central processing units (CPUs). Graphics processor 124 includes any technically feasible set of hardware units configured to process graphics data and execute graphics applications. For example, graphics processor 124 could include one or more graphics processing units (GPUs). I/O devices 126 include any technically feasible set of devices configured to perform input and/or output operations, including, for example, a universal serial bus (USB) port, among others. Memory 128 includes any technically feasible storage media configured to store data and software applications, such as, for example, a hard disk and/or a random-access memory (RAM) module, among others. Memory 128 includes a device driver 130 and a software application 132.

Device driver 130 includes program code that is executed by processor 122 to coordinate the operation of graphics processor 124. During execution, device driver 130 acts as an interface to graphics processor 124. Software application 132 includes program code that is executed by processor 122 to generate graphics processing tasks to be performed by graphics processor 124. In operation, software application 132 transmits these graphics processing tasks to device driver 130, and device driver 130 generates machine code that can be executed by graphics processor 124 to perform the graphics processing tasks. The graphics processing tasks could include, for example, graphics rendering operations, encoding operations, decoding operations, and so forth.

When performing graphics rendering operations, graphics processor 124 generates images on behalf of software application 132 and then causes display device 110 to display those images. For example, software application 132 could be a video game that leverages graphics processor 124 to render images depicting a simulating environment. Display device 110 could display these images to the user via display screen 112. In various embodiments, display device 110 receives video data from a source other than computing device 120, including, for example, a video disc player, a set top box, a generic hardware component that includes a video decoder, a streaming video service, and so forth.

As described in greater detail below in conjunction with FIGS. 2-10, display controller 114 within display device 110 manages the operation of display screen 112 in order to cause images displayed via display screen 112 to have accurate colors and luminances. Display screen 112 is described in greater detail below in conjunction with FIG. 2.

Figure 2:
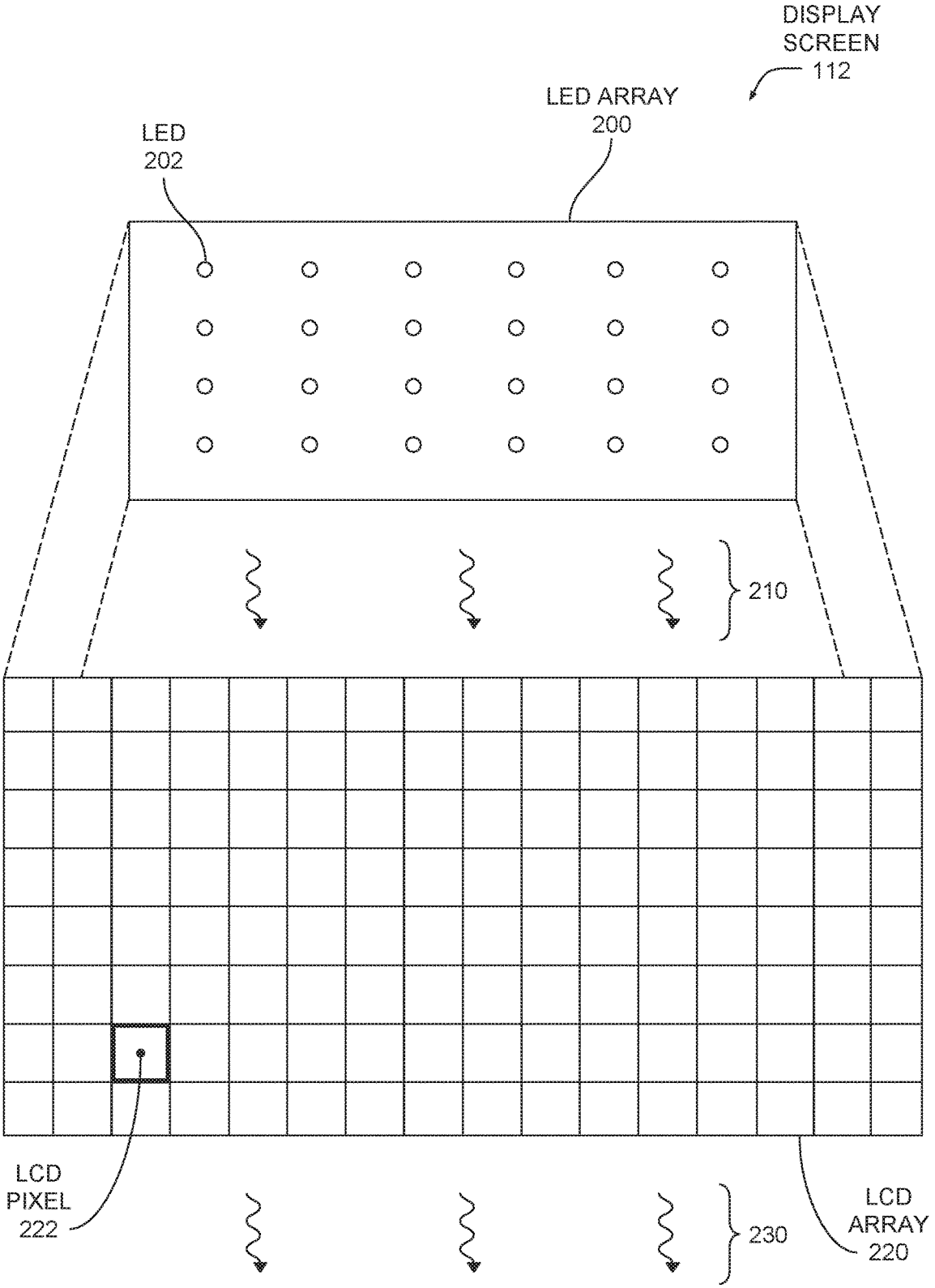
FIG. 2 is a more detailed illustration of the display screen of FIG. 1, according to various embodiments of the present invention.

FIG. 2 is a more detailed illustration of the display screen of FIG. 1, according to various embodiments of the present invention. As shown, display screen 112 includes an LED array 200 that includes a plurality of LEDs 202. LED array 200 may be known in the art as a "backlight." Display screen 112 also includes an LCD array 220 that includes a plurality of LCD pixels 222. LED array 200 is coupled to LCD array 220 and configured to emit light 210 to illuminate LCD array 220. LCD pixels 222 are at least partially translucent and therefore allow the re-transmission of any received light. Each LCD pixel 222 can be configured to filter the red, green, and blue (RGB) color components of light 210 and to then emit light 230 with a desired RGB color value. The operation of an exemplary LCD pixel 222 is described in greater detail below in conjunction with FIG. 3.

Figure 3:
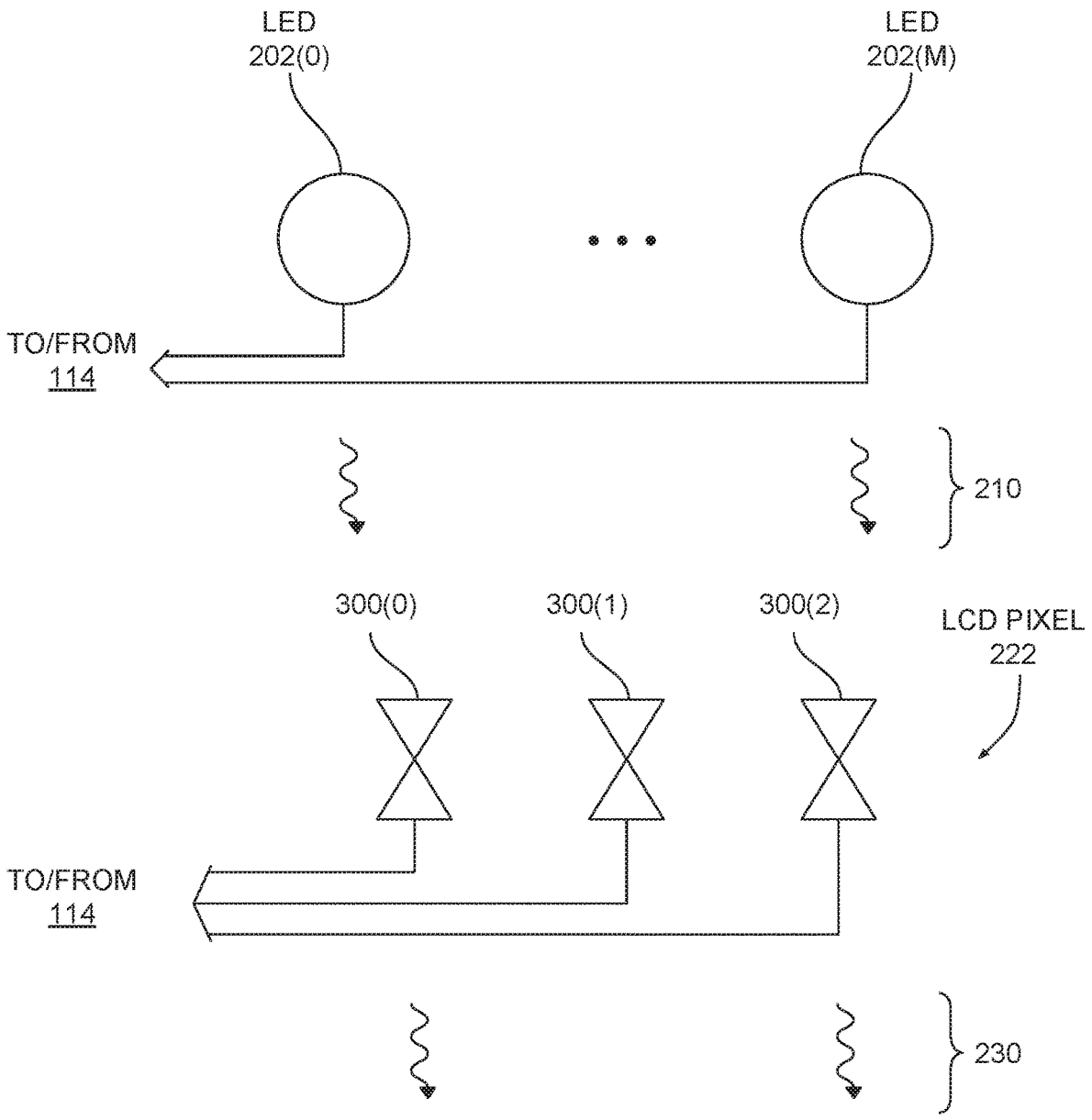
FIG. 3 is a more detailed illustration of one of the LCD pixels of FIG. 2, according to various embodiments of the present invention.

FIG. 3 is a more detailed illustration of an LCD pixel of FIG. 2, according to various embodiments of the present invention. As shown, an LCD pixel 222 includes valves 300(0), 300(1), and 300(2). A given valve 300 controls the amount of red, green, or blue light that is filtered by LCD pixel 222. In particular, valve 300(0) controls the filtering of red light, valve 300(1) controls the filtering of green light, and valve 300(2) controls the filtering of blue light. LCD pixel 222 receives light 210 from LEDs 202(0) through 202(M). LEDs 202(0) through 202(M) include some or all LEDs included in LED array 200. Based on the settings of valves 300, LCD pixel 222 filters light 210 and then outputs light 230 having a specific red, green, blue (RGB) color value.

Display controller 114 controls the brightness of LEDs 202 by supplying varying levels of current to each LED 202. For example, display controller 114 could cause an LED 202 to output light with an elevated brightness by supplying an elevated current level to that LED. Display controller 114 controls the color of light emitted by LCD pixel 222 by setting different percentages with which valves 300 should filter red, green, and blue light. For example, display controller 114 could cause LCD pixel 222 to output a purely blue light by setting valves 300(0) and 300(1) to filter 100% of red light and 100% of green light and filter 0% of blue light, thereby allowing only the blue component of light 210 to pass through LCD pixel 222 relatively unfiltered. As a general matter, display controller 114 controls the operation of LEDs 202 and LCD pixels 222 based on the image to be displayed, as described in greater detail below in conjunction with FIG. 4.

Figure 4:
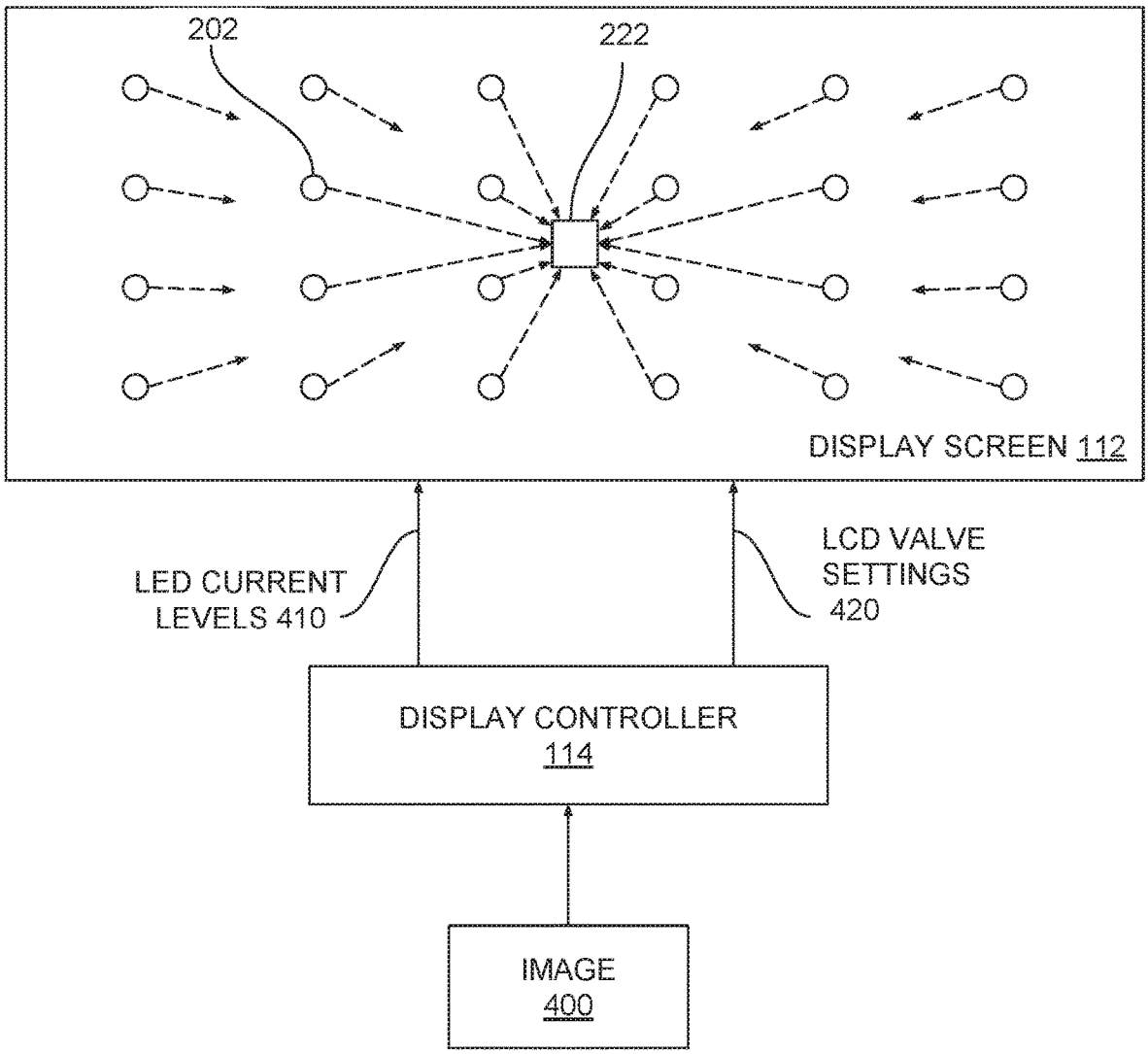
FIG. 4 illustrates how the display controller of FIG. 1 causes an image to be displayed, according to various embodiments of the present invention.
Figure 5:
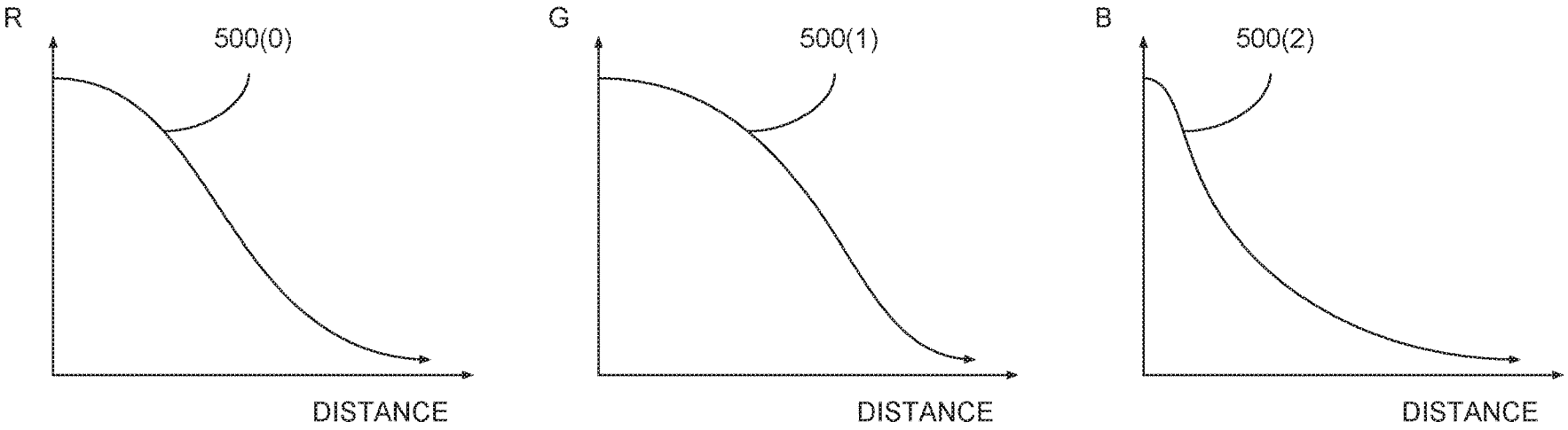
FIG. 5 illustrates how different color components can vary as a function of distance from an LED, according to various embodiments of the present invention.
Figure 6:
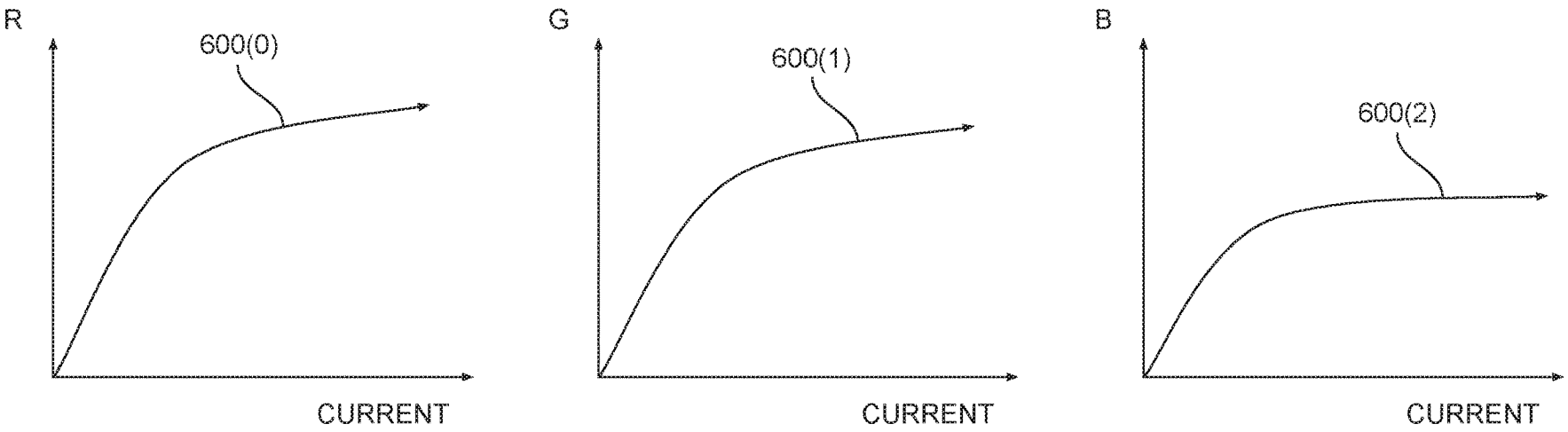
FIG. 6 illustrates how different color components vary as a function of current supplied to an LED, according to various embodiments of the present invention.

FIG. 4 illustrates how the display controller of FIG. 1 causes an image to be displayed, according to various embodiments of the present invention. As shown, display controller 114 receives an image 400 and then generates LED current levels 410 and LCD valve settings 420. When generating LED current levels 410, display controller 114 performs an image processing operation with image 400 to determine a target brightness for each LED 202. Display controller 114 then determines the specific current level that should be supplied to each LED 202 to achieve the target brightness.

When generating LCD valve settings 420, display controller 114 maps each LCD pixel 222 to a corresponding portion or pixel of image 400 in order to determine a target RGB color value for each LCD pixel 222. Display controller 114 then determines LCD valve settings 420 for LCD pixels 222 based on the target RGB color value and based on contributions of light received from some or all LEDs 202. Many LEDs 202 contribute light 210 to a given LCD pixel 222, as is shown. The color of the contributed light can vary based on at least two factors.

A first factor is that light received at a given LCD pixel 222 from a given LED 202 typically has a color that varies depending on the distance between the given LCD pixel 222 and the given LED 202. For example, referring now to FIG. 5, graphs 500 illustrate how the red, green, and blue color components of light received at a given LCD pixel 222 change as a function of distance from a given LED 202. Graph 500(0) indicates how the red color component changes with distance. Graph 500(1) indicates how the green color component changes with distance. Graph 500(2) indicates how the blue color component changes with distance. One can observe that the blue color component degrades over distance much faster than the red color component and the green color component. Accordingly, a given LCD pixel 222 receives more blue light from nearby LEDs 202 compared to more yellow light received from distant LEDs 202.

A second factor is that LEDs 202 that are supplied with different current levels emit light having different colors. Accordingly, the light received at a given LCD pixel 222 from a given LED 202 has a color that varies depending on the current level supplied to the given LED 202. For example, referring now to FIG. 6, graphs 600 illustrate how the red, green, and blue color components of light received at a given LCD pixel 222 change as a function of current supplied to a given LED 202. Graph 600(0) indicates how the red color component changes with supplied current. Graph 600(1) indicates how the green color component changes with supplied current. Graph 600(2) indicates how the blue color component changes with supplied current. One can observe that the blue color component degrades quickly with increasing current levels. Thus, a given LCD pixel 222 receives more blue light from LEDs 202 supplied with lower current levels compared to those supplied with higher current levels.

Display controller 114 is configured to compensate for color variations caused by either or both of the factors discussed above. Display controller 114 is described in greater detail below in conjunction with FIG. 7.

Display Controller

Figure 7:
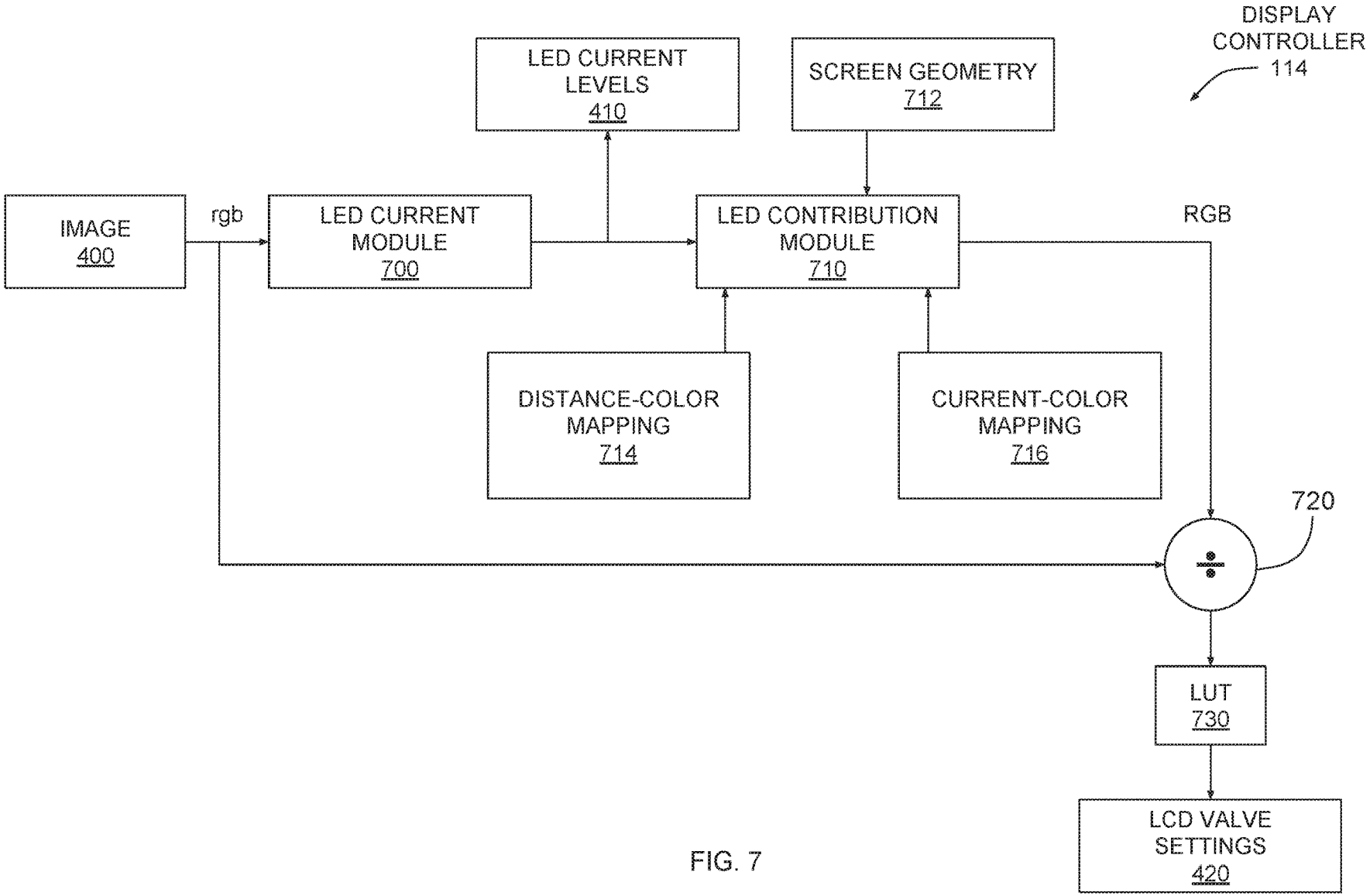
FIG. 7 is a more detailed illustration of the display controller of FIG. 1, according to various embodiments of the present invention.

FIG. 7 is a more detailed illustration of the display controller of FIG. 1, according to various embodiments of the present invention. As shown, display controller 114 includes an LED current module 700, an LED contribution module 710, a divider 720, and a look-up table (LUT) 730. In operation, display controller 114 receives image 400 and determines red, green, and blue color components (shown as rgb) associated with different portions or pixels of the image. For example, display controller 114 could extract these color components directly from pixels of image 400 or perform a sampling operation to generate the color components. Each of the red, green, and blue color components indicate an intensity with which the associated color should be displayed by a corresponding LCD pixel 222.

LED current module 700 analyzes image 400 to generate LED current levels 410. For example, LED current module 700 could analyze the luminance of different portions or pixels of image 400 and determine corresponding brightness levels for LEDs 202. LED current module 700 could then determine the appropriate current levels for LEDs 202 to achieve the determined brightness levels. LED current module 700 supplies LEDs 202 with current according to current levels 410 and also provides current levels 410 to LED contribution module 710.

LED contribution module 710 determines the amount of red, green and blue light contributed by LEDs 202 to LCD pixels 222. As discussed above, the color of light received at any given LCD pixel 222 can vary based on at least two different factors. In various embodiments, LED contribution module 710 compensates for the color variations that arise based on either or both of these factors.

In a first embodiment, LED contribution module 710 compensates for color variations that arise based on varying distances between LEDs 202 and LCD pixels 222. These color variations are described above by way of example in conjunction with FIG. 5. In this embodiment, LED contribution module 710 may determine the color contributions to each LCD pixel 222 from some or all LEDs 202 based LED current levels 410, on screen geometry 712 and distance-color mapping 714. Screen geometry 712 indicates the distance between each LED 202 and each LCD pixel 222. Distance-color mapping 714 is a look-up table that indicates, for a specific distance between a given LED 202 and a given LCD pixel 222, the color and luminance of light contributed by the given LED 202 to the given LCD pixel 222. Distance-color mapping 714 could include, for example, a set of International Commission on Illumination (CIE) 1931 color/luminance entries that are indexed by distance values. An example of distance-color mapping 714 that includes CIE 1931 color/luminance entries is shown below in Table 1:

TABLE 1

| | CIE 1931 color/luminance | | |
|---|---|---|---|
| DISTANCE | x | y | L |
| 0 | 0.2762 | 0.2840 | 104.020 |
| −1 | 0.2760 | 0.2840 | 103.200 |
| −2 | 0.2770 | 0.2852 | 101.880 |
| −4 | 0.2789 | 0.2879 | 97.899 |
| −6 | 0.2801 | 0.2898 | 91.835 |
| −8 | 0.2831 | 0.2927 | 84.524 |
| −10 | 0.2857 | 0.2953 | 76.998 |
| −12 | 0.2889 | 0.2994 | 69.161 |
| −14 | 0.2920 | 0.3027 | 61.374 |
| −16 | 0.2957 | 0.3091 | 54.834 |
| −18 | 0.3003 | 0.3123 | 48.050 |
| −20 | 0.3047 | 0.3187 | 42.519 |
| −22 | 0.3084 | 0.3230 | 37.362 |
| −24 | 0.3132 | 0.3279 | 32.974 |
| −26 | 0.3157 | 0.3312 | 29.338 |
| −28 | 0.3189 | 0.3340 | 26.035 |
| −30 | 0.3215 | 0.3356 | 23.267 |
| −32 | 0.3238 | 0.3377 | 20.886 |
| −34 | 0.3253 | 0.3384 | 18.765 |
| −36 | 0.3270 | 0.3393 | 16.875 |
| . . . | . . . | . . . | . . . |

Table 1 is a mapping between distance values and color/luminance entries expressed as (x, y, L) coordinates. Each color/luminance entry indicates a specific position in the CIE 1931 color space. The x and y coordinates indicate a specific color in the CIE 1931 color space, while the L coordinate indicates a luminance for that color. In addition to CIE 1931, distance-color mapping 714 may be defined according to any technically feasible color space. Distance-color mapping 714 is generated based on an empirical analysis of an instance of display device 110. The empirical analysis used to generate distance-color mapping 714 is described in greater detail below in conjunction with FIG. 9.

In a second embodiment, LED contribution module 710 compensates for color variations that arise based on differing current levels supplied to LEDs 202. In this embodiment, LED contribution module 710 may determine the color contributions to each LCD pixel 222 from some or all LEDs 202 based on LED current levels 410 and current-color mapping 716. As discussed above in conjunction with FIG. 4, LED current levels 410 include the specific current levels to be supplied to each LED 202. Current-color mapping 716 is a look-up table that indicates, for a given current level supplied to an LED 202, the color and intensity of light produced by that LED 202. Current-color mapping 716 could include, for example, a set of International CIE 1931 color/luminance entries indexed by current level. Table 2 illustrates an example of current-color mapping 716 that includes CIE 1931 color/luminance entries:

TABLE 2

| | | CIE 1931 COLOR/LUMINANCE | | |
|---|---|---|---|---|
| SETTING | CURRENT | x | y | L |
| 1 | 0.8 | 0.2749 | 0.2823 | 2.1027 |
| 2 | 1.4 | 0.2749 | 0.2822 | 3.3134 |
| 3 | 1.9 | 0.2749 | 0.2823 | 4.5453 |
| 4 | 2.5 | 0.2748 | 0.2823 | 5.7907 |
| 5 | 3.1 | 0.275 | 0.2824 | 7.0391 |
| 6 | 3.7 | 0.2749 | 0.2823 | 8.301 |
| 7 | 4.2 | 0.275 | 0.2825 | 9.5829 |
| 8 | 4.8 | 0.2749 | 0.2824 | 10.863 |
| 9 | 5.4 | 0.275 | 0.2825 | 12.167 |
| 10 | 6.0 | 0.275 | 0.2825 | 13.41 |
| 12 | 7.1 | 0.2751 | 0.2826 | 15.949 |
| 16 | 9.5 | 0.2752 | 0.2826 | 21.174 |
| 20 | 11.8 | 0.2752 | 0.2827 | 26.307 |
| 22 | 13.0 | 0.2753 | 0.2828 | 28.847 |
| 25 | 14.7 | 0.2753 | 0.2829 | 32.724 |
| 30 | 17.6 | 0.2754 | 0.283 | 39.043 |
| 35 | 20.6 | 0.2754 | 0.283 | 45.493 |
| 40 | 23.5 | 0.2755 | 0.2831 | 51.787 |
| 50 | 29.3 | 0.2756 | 0.2833 | 64.414 |
| . . . | . . . | . . . | . . . | . . . |

Table 2 is a mapping between current settings and corresponding current levels and color/luminance entries expressed as (x, y, L) coordinates. In the example shown, each color/luminance entry indicates a specific position in the CIE 1931 color space, although current-color mapping 716 may be defined according to any technically feasible color space other than CIE 1931. Current-color mapping 716 is generated based on an empirical analysis of an instance of display device 110. The empirical analysis used to generate current-color mapping 716 is described in greater detail below in conjunction with FIG. 10.

LED contribution module 710 is configured to implement the techniques associated with either or both of the first embodiment and the second embodiment to determine the color contributions provided to each LCD pixel 222 by some or all LEDs 202. When implementing both techniques, in one embodiment, LED contribution module 710 may determine RGB color values contributed to a given LCD pixel based on LED current levels 410 and current-color mapping 716. LED contribution module 710 may then modify the determined RGB color values based on screen geometry 512 and distance-color mapping 714. For example, LED contribution module 710 could multiply the determined RGB color values by a distance degradation function derived from distance-color mapping 714.

With any one or more of the approaches described above, LED contribution module 710 generates RGB color components for each LCD pixel 222 (shown as RGB). These RGB color components indicate pre-existing color components and intensity values at the back of LCD pixels 222 for which compensation is needed to cause those LCD pixels 222 to output accurate color values.

Divider 720 receives the rgb color components that are derived from image 400 and associated with specific LCD pixels 222. Divider 720 also receives the RGB color components generated by LED color contribution module 710. For a given LCD pixel 222, divider 222 divides each of the r, g, and b color components generated for the LCD pixel 222 by the corresponding R, G, and B color components generated for that LCD pixel 222. This computation results in the percentage of red, green and blue light the LCD pixel 222 should be configured to filter in order to accurately reproduce the desired color value indicated by the rgb color components.

For example, suppose a given portion of image 400 has a blue intensity of b=0.5. However, LED contribution module 710 determines that an LCD pixel 222 corresponding to the given portion of the image has a pre-existing blue intensity of B=1, potentially caused by a nearby LED 202. Dividing b=0.5 by B=1 yields a percentage value of 50%, meaning that the LCD pixel 222 should filter 50% of the received blue light (B=1) in order to output light with the desired blue intensity (b=0.5).

Divider 720 transmits the computed percentages to LUT 530, and LUT 530 then translates these percentage values into LCD valve settings 420. Display controller 114 configures LCD valves 300 according to these settings in order cause display screen 112 to display image 400 with high-precision color values.

Advantageously, display controller 114 compensates for unwanted color contributed by LEDs 202. These unwanted color contributions can arise because the color of light produced by LEDs 202 varies over different distances and/or because the color of light produced by LEDs 202 varies based on applied current. Conventional display controllers lack any mechanisms to compensate for these unwanted color contributions. Consequently, conventional display devices oftentimes display images with inaccurate colors. Such images may appear unrealistic to users, leading to a poor user experience. Accordingly, the disclosed techniques confer multiple technological advantages over prior art display devices. The operation of display controller 114 is described in stepwise fashion below in conjunction with FIG. 8.

Figure 8:
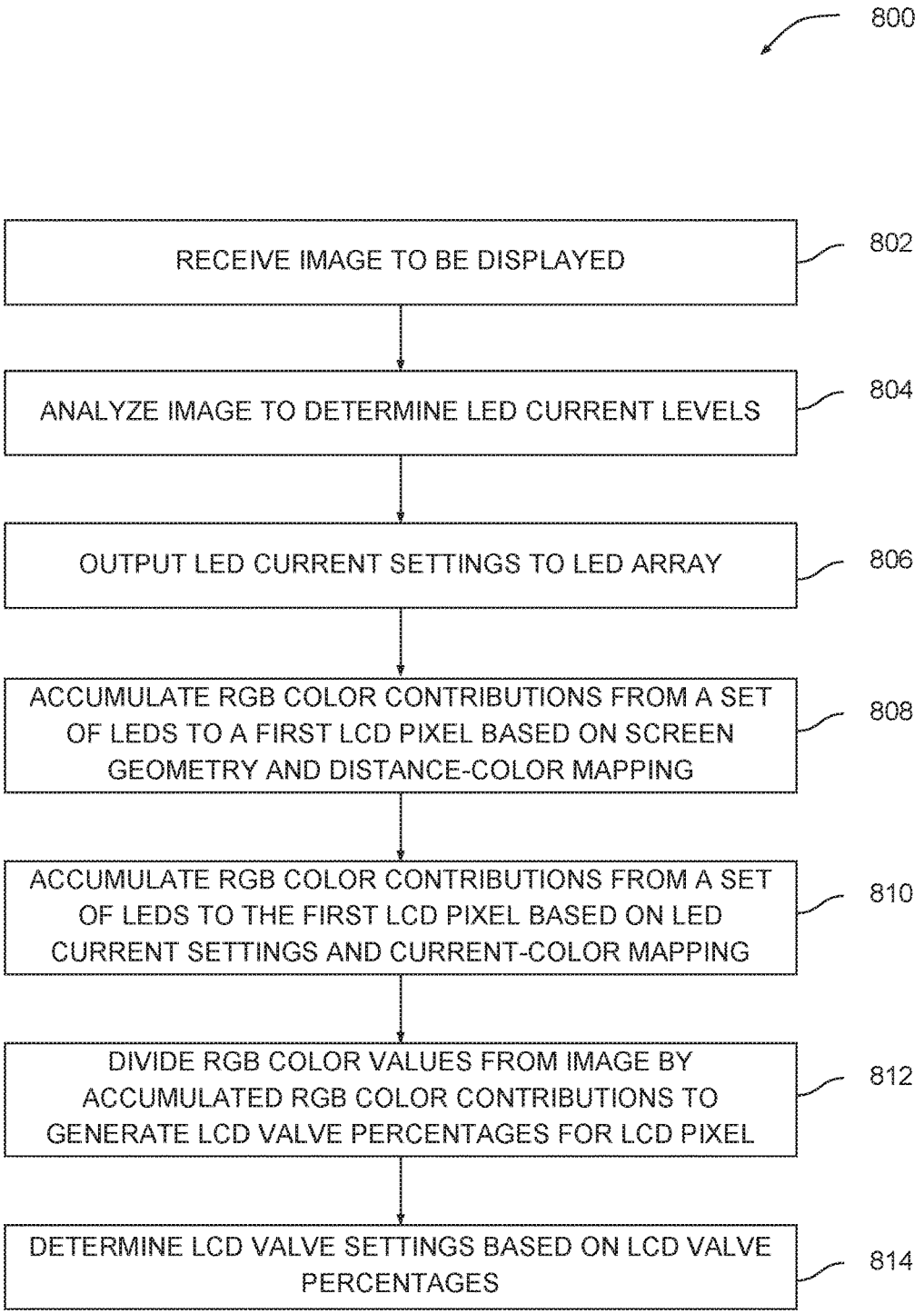
FIG. 8 is a flow diagram of method steps for configuring an LCD pixel to output light with a desired color value, according to various embodiments of the present invention.

FIG. 8 is a flow diagram of method steps for configuring an LCD pixel to output light with a desired color value, according to various embodiments of the present invention. Although the method steps are described in conjunction with the systems of FIGS. 1-7, persons skilled in the art will understand that any system configured to perform the method steps in any order falls within the scope of the present invention.

As shown, a method 800 begins at step 802, where display controller 114 receives an image to be displayed. The image may indicate a set of RGB color values for different pixels of the image, or display controller 114 may sample the image to generate these RGB color values. At step 804, display controller 114 analyzes the image to determine current levels to be supplied to LEDs 202 included in LED array 200. Each LED 202 emits light with a different brightness depending on the supplied current level. Different current levels can also cause LEDs 202 to emit light with varying colors. At step 806, display controller 114 outputs LED current levels 410 to LED array 200, thereby causing LED array 200 to illuminate LCD array 220.

At step 808, display controller 114 accumulates RGB color contributions from a set of LEDs 202 to a first LCD pixel 222 based on screen geometry 512 and distance-color mapping 714. The set of LEDs 202 may include some or all LEDs 202 included in LED array 200. Display controller 114 analyzes screen geometry 712 to determine the distances between each LED 202 in the set of LEDs 202 and the first LCD pixel 222. In one embodiment, screen geometry 712 includes a look-up table of distances between LEDs 202 and LCD pixels 222. Display controller 114 determines the RGB color contributions from each LED 202 in the set of LEDs 202 based on distance-color mapping 714. In embodiments where distance-color mapping 714 references a non-RGB color space, such as the CIE 1931 color space, display controller 114 may convert extracted color values into RGB color contributions, although in practice, any technically feasible color space can be implemented. An approach for generating distance-color mapping 714 is described below in conjunction with FIG. 9.

At step 810, display controller 114 accumulates RGB color contributions from the set of LEDs 202 to a first LCD pixel 222 based on LED current levels 410 and current-color mapping 716. In one embodiment, display controller 114 accumulates the RGB color contributions from a different set of LEDs 202. Display controller 114 determines the RGB color contributions from each LED 202 in the set of LEDs 202 based on the current level supplied to those LEDs 202 and current-color mapping 716. In embodiments where current-color mapping 716 references a non-RGB color space, such as the CIE 1931 color space, display controller 114 converts extracted color values into RGB color contributions. An approach for generating current-color mapping 716 is described below in conjunction with FIG. 10.

In various embodiments, display controller 114 may perform either or both of steps 808 and 810 in order to determine the RGB color contributions from LEDs 202. When performing both of steps 808 and 810, display controller 114 combines the RGB color contributions determined at these respective steps to generate a total RGB color contribution. For example, display controller 114 could first determine the RGB color contribution for the first LCD pixel 222 based on LED current settings 410. Then display controller 114 could multiply each of these RGB color contributions by two-dimensional (2D) pixel spread functions that track red, green, and blue luminance degradation as a function of distance. These 2D pixel spread functions could be derived from distance-color mapping 714.

At step 812, display controller 114 divides the rgb color values associated with the image by the RGB color contributions accumulated at one or both of steps 808 and 810 to generate a set of LCD valve percentages. These percentages indicate the degree to which the LCD valves 300 of the first LCD pixel 222 should be opened or closed to cause the first LCD pixel 222 to emit light having the desired RGB color value. At step 814, display controller 114 determines LCD valve settings 420 for configuring LCD valves 300 based on the LCD valve percentages determined at step 812 and based on LUT 730. Display controller 114 may repeat steps 808, 810, 812, and 814 for each LCD pixel 222 included in LCD array 220, thereby configuring those pixels to output light with highly accurate color values.

As discussed above in conjunction with FIG. 7, distance-color mapping 714 and current-color mapping 716 are generated via empirical analyses of an instance of display device 110. In some embodiments display controller 114 performs these empirical analyses in conjunction with various testing equipment that is not described herein. The empirical analysis used to generate distance-color mapping 714 is described below in conjunction with FIG. 9. The empirical analysis used to generate current-color mapping 716 is described below in conjunction with FIG. 10.

Empirical Analysis for Generating Distance-Color Mapping

Figure 9:
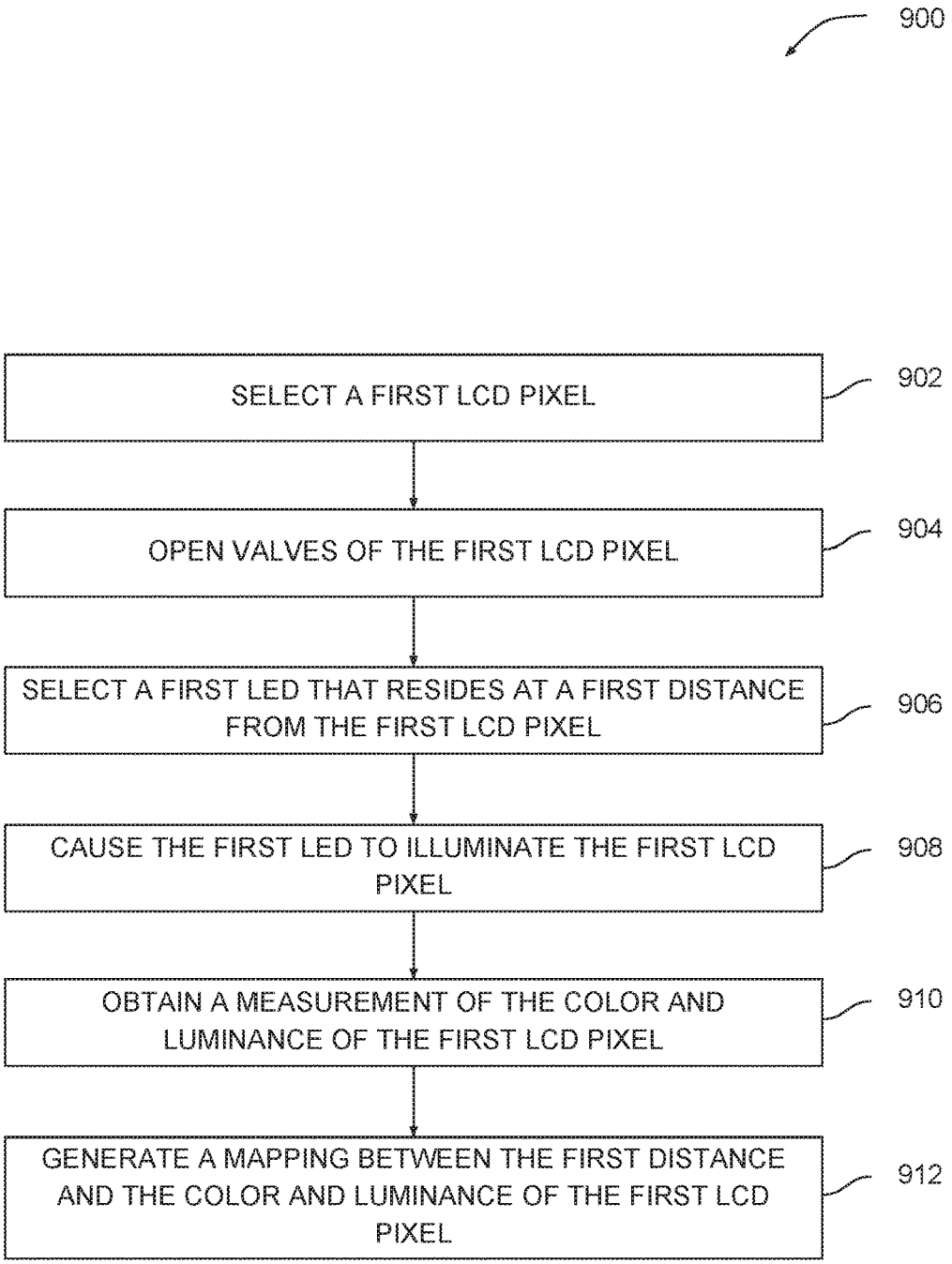
FIG. 9 is a flow diagram of method steps for generating a mapping between distances between LEDs and LCD pixels and color values of the LCD pixels, according to various embodiments of the present invention.

FIG. 9 is a flow diagram of method steps for generating a mapping between distances between LEDs and LCD pixels and color values of the LCD pixels, according to various embodiments of the present invention. Although the method steps are described in conjunction with the systems of FIGS. 1-8, persons skilled in the art will understand that any system configured to perform the method steps in any order falls within the scope of the present invention.

As shown, a method 900 begins at step 902, where display controller 114 select a first LCD pixel 222. Display controller 114 may select an LCD pixel 222 that is close to the center of display screen 112 and therefore susceptible to receiving light from many different LEDs 202, although any LCD pixel 222 may also be selected. At step 904, display controller 114 opens each valve 300 of the first LCD pixel 222 to 100%, thereby permitting light transmitted by LEDs 202 to pass through the first LCD pixel 222 mostly unfiltered.

At step 906, display controller 114 selects a first LED 202 that resides at a first distance from the first LCD pixel 222. Because LED array 200 includes many LEDs 202, display controller 114 may select LEDs 202 that reside at many different distances from the first LCD pixel 222. At step 908, display controller 114 causes the first LED 202 to illuminate the first LCD pixel 222. In doing so, display controller 114 supplies a first current level to the first LED 202 that does not change during the empirical analysis discussed herein.

At step 910, display controller 114 obtains a measurement of the color and luminance of the first LCD pixel 222. For example, display controller 114 could interact with a light sensor coupled to display screen 112 to obtain this measurement. At step 912, display controller 114 generates a mapping between the first distance and the color and luminance of the first LCD pixel 222. Display controller 114 may repeat the method 900 for many different LEDs 202 and many different LCD pixels 222 in order to expand the mapping to include entries for many different distances. Display controller 114 can perform these above-described operations with any technically feasible color space. In this manner, display controller 114 can generate distance-color mapping 714. In some embodiments, display controller 114 operates in conjunction with various test equipment, as mentioned. In other embodiments, the method 900 is performed entirely by the test equipment.

Empirical Process for Generating Current-Color Mapping

Figure 10:
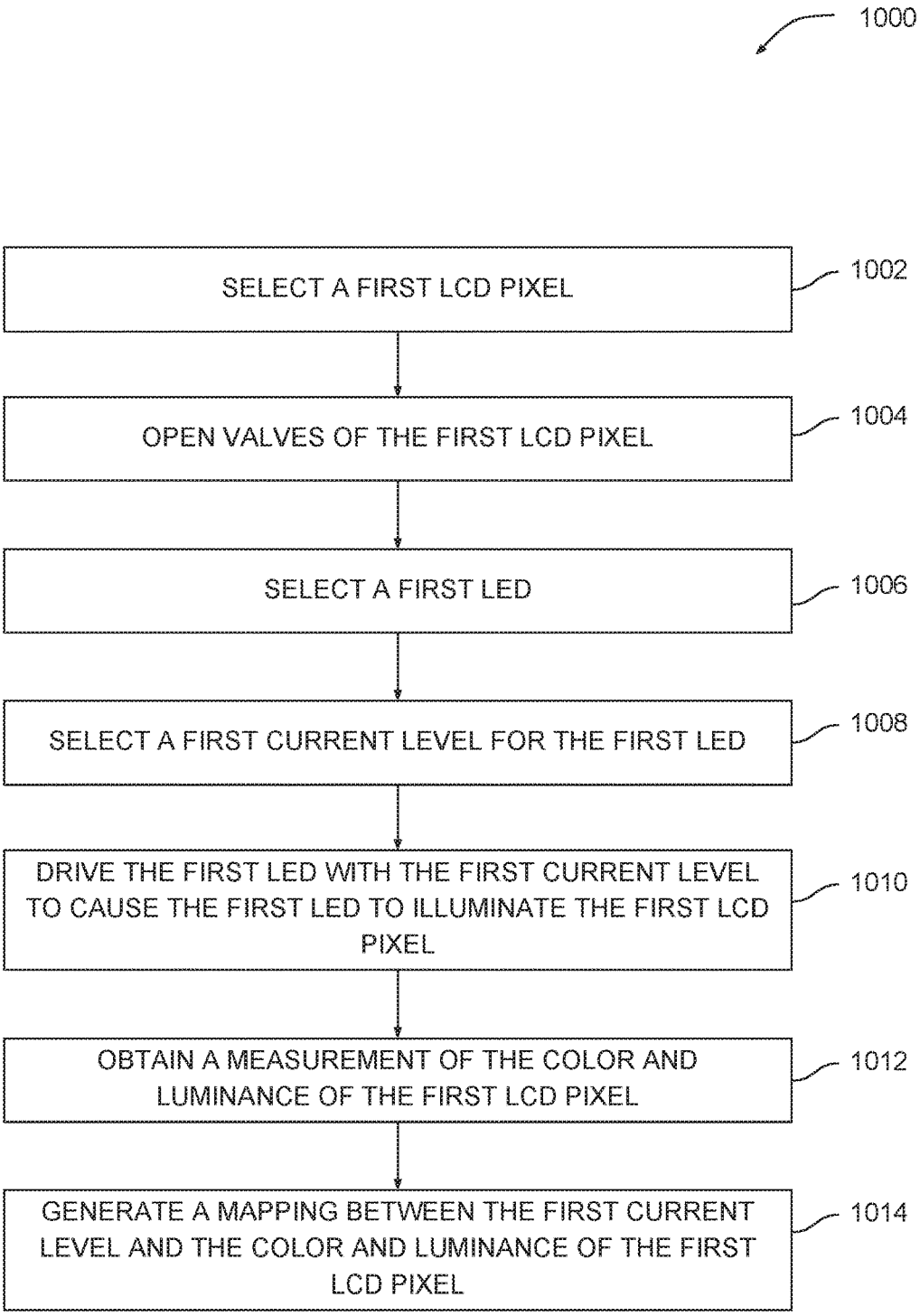
FIG. 10 is a flow diagram of method steps for generating a mapping between current levels supplied to LEDs and color values of illuminated LCD pixels, according to various embodiments of the present invention.

FIG. 10 is a flow diagram of method steps for generating a mapping between current levels supplied to LEDs and color values of illuminated LCD pixels, according to various embodiments of the present invention. Although the method steps are described in conjunction with the systems of FIGS. 1-8, persons skilled in the art will understand that any system configured to perform the method steps in any order falls within the scope of the present invention.

As shown, a method 1000 begins at step 1002, where display controller 114 select a first LCD pixel 222. Display controller 114 can select any LCD pixel 222, although LCD pixels 222 that reside close to the center of display screen 112 may be tested more easily. At step 1004, display controller 114 opens each valve 300 of the first LCD pixel 222 to 100% to permit the relatively unfiltered passage of light. In one embodiment, display controller 114 may perform step 1002 with a small square or circle of LCD pixels 222 instead of just one LCD pixel 222.

At step 1006, display controller 114 selects a first LED 202. Display controller 114 may select any LED 202, although in practice display controller 114 selects an LED 202 that is not excessively distant from the first LCD pixel 222. At step 1008, display controller 114 select a first current level to supply to the first LED 202. The first current level falls within a range of current levels to be tested during the empirical analysis described herein.

At step 1010, display controller 114 supplies the first LED 202 with the first current level to cause the first LED 202 to illuminate the first LCD pixel 222. Because valves 300 of the first LCD pixel 222 are open, light emitted by the first LED 202 passes through the first LCD pixel 222 with minimal filtration. At step 1012, display controller 114 obtains a measurement of the color and luminance of the first LCD pixel 222. Display controller 114 could interact with external test equipment to perform step 1012, for example. The color of the received light generally depends on the first current level. At step 1014, display controller 114 generates a mapping between the first current level and the color and luminance of the first LCD pixel 222. In this manner, display controller 114 generates an entry in current-color mapping 716. Display controller 114 may repeat the method 1000 with different current levels to generate additional entries.

Referring generally to FIGS. 9-10, display controller 114 can perform the methods 900 and 1000 in conjunction with any technically feasible test equipment, including luminance and/or chrominance sensors, among others. In addition, the methods 900 and 1000 can be performed with different display devices in order to generate mappings specific to those display devices.

In sum, a display device includes an array of LEDs, an array of LCD pixels, and a display controller. The display controller is configured to compensate for one or more sources of color variation in light produced by the LEDs. The display controller can determine a first color variation at a given LCD pixel based on the distance between the given LCD pixel and one or more LEDs. The display controller can also determine a second color variation at the given LCD pixel based on a current level supplied to the one or more LEDs. The display controller configures the given LCD pixel to filter light that is received from the one or more LEDs in a manner that reduces or eliminates either or both of the first and second color variations. The display controller configures each LCD pixel to cause the array of LCD pixels to display an image with accurate colors.

At least one advantage of the disclosed techniques is that different regions of LCD pixels can output colors having different brightnesses with limited color variations that arise due to the distances between LCD pixels and LEDs. Accordingly, the LCD pixels can more accurately emit light having a specific color. Another advantage of the disclosed techniques is that different LCD pixels can be supplied with different current levels with limited color variations that arise due to these different current levels. Accordingly, the LCD pixels can more accurately emit light having a specific color. Improving color accuracy improves the accuracy with which images can be displayed, thereby leading to an improved user experience. Accordingly, the disclosed techniques represent multiple technological improvements over prior art systems that do not compensate for any of the above color variations.

1. Some embodiments include a computer-implemented method for configuring a plurality of screen pixels to display an image, the method comprising determining a first current level to be supplied to a first light source based on a first image, determining a first color value associated with a first portion of the first image, determining a first screen pixel responsible for displaying at least part of the first portion of the first image, determining, based on the first current level, a second color value associated with light that is contributed to the first screen pixel by the first light source, and configuring the first screen pixel to output light having the first color value based on a function of the first color value and the second color value.

2. The computer-implemented method of clause 1, wherein determining the first current level comprises analyzing the first image to determine a target output for the first light source, and mapping the target output to the first current level.

3. The computer-implemented method of any of clauses 1-2, wherein determining the second color value comprises evaluating, based on the first current level, a first mapping that indicates a plurality of color values indexed by a plurality of current levels.

4. The computer-implemented method of any of clauses 1-3, further comprising generating the first mapping by selecting a second screen pixel included in a display screen, configuring the second screen pixel to transmit received light, selecting a second light source that is included in the display screen, selecting a second current level, supplying the second light source with the second current level to cause the second light source to illuminate the second screen pixel, obtaining a measurement of a color value associated with light emitted by the second screen pixel when illuminated by the second light source, and generating a map entry that includes the second current level and the measurement of the color value.

5. The computer-implemented method of any of clauses 1-4, wherein configuring the first screen pixel to output light having the first color value comprises evaluating the function of the first color value and the second color value by dividing the first color value by the second color value to generate a first percentage, configuring the first screen pixel to filter a first color component of light based on the first percentage, and causing the first light source to illuminate the first screen pixel, wherein the first screen pixel compensates for light contributed by the first light source to the first screen pixel when outputting light having the first color value.

6. The computer-implemented method of any of clauses 1-5, wherein configuring the first screen pixel to filter the first color component of light comprises adjusting a first valve associated with the first screen pixel based on the first percentage, wherein the first valve controls an amount of red light, green light, or blue light filtered by the first screen pixel.

7. The computer-implemented method of any of clauses 1-6, wherein determining the first color value associated with the first portion of the first image comprises sampling a red value, green value, or blue value associated with a first pixel that resides within the first portion of the first image.

8. The computer-implemented method of any of clauses 1-7, wherein the first screen pixel comprises a liquid-crystal display pixel, and the first light source comprises a light-emitting diode.

9. The computer-implemented method of any of clauses 1-8, further comprising determining a first distance between the first light source and the first screen pixel, evaluating a second mapping based on the first distance to determine a third color value, wherein the first light source contributes light having the third color value to the first screen pixel when separated from the first screen pixel by the first distance, and re-configuring the first screen pixel to output light having the first color value based on a first percentage that is generated by dividing the first color value by the third color value.

10. The computer-implemented method of any of clauses 1-9, wherein the second mapping indicates a plurality of color values and associated luminance values indexed by a plurality of distances.

11. Some embodiments include a display device, comprising a display screen, including a plurality of light sources, and a plurality of screen pixels that emit light when illuminated by the plurality of light sources, and a display controller that causes the display screen to display a first image by performing the steps of determining a first current level to be supplied to a first light source based on the first image, determining a first color value associated with a first portion of the first image, determining a first screen pixel responsible for displaying at least part of the first portion of the first image, determining, based on the first current level, a second color value associated with light that is contributed to the first screen pixel by the first light source, and configuring the first screen pixel to output light having the first color value based on a function of the first color value and the second color value.

12. The display device of clause 11, wherein the display controller determines the first current level by analyzing the first image to determine a target output for the first light source, and mapping the target output to the first current level.

13. The display device of any of clauses 11-12, wherein the display controller determines the second color value by evaluating, based on the first current level, a first mapping that indicates a plurality of color values indexed by a plurality of current levels.

14. The display device of any of clauses 11-13, wherein the display controller generates the first mapping by selecting a second screen pixel included in a display screen, configuring the second screen pixel to transmit received light, selecting a second light source that is included in the display screen, selecting a second current level, supplying the second light source with the second current level to cause the second light source to illuminate the second screen pixel, obtaining a measurement of a color value associated with light emitted by the second screen pixel when illuminated by the second light source, and generating a map entry that includes the second current level and the measurement of the color value.

15. The display device of any of clauses 11-14, wherein a first optical sensor generates the measurement of the color value during a testing procedure.

16. The display device of any of clauses 11-15, wherein the display controller configures the first screen pixel to output light having the first color value by evaluating the function of the first color value and the second color value by dividing the first color value by the second color value to generate a first percentage, configuring the first screen pixel to filter a first color component of light based on the first percentage, and causing the first light source to illuminate the first screen pixel, wherein the first screen pixel compensates for light contributed by the first light source to the first screen pixel when outputting light having the first color value.

17. The display device of any of clauses 11-16, wherein the display controller configures the first screen pixel to filter the first color component of light comprises adjusting a first valve associated with the first screen pixel based on the first percentage, wherein the first valve controls an amount of red light, green light, or blue light filtered by the first screen pixel.

18. The display device of any of clauses 11-17, wherein the display controller determines the first color value associated with the first portion of the first image by sampling a red value, green value, or blue value associated with a first pixel that resides within the first portion of the first image.

19. The computer-implemented method of any of clauses 11-18, further comprising determining a first distance between the first light source and the first screen pixel, evaluating a second mapping based on the first distance to determine a third color value, wherein the first light source contributes light having the third color value to the first screen pixel when separated from the first screen pixel by the first distance, and re-configuring the first screen pixel to output light having the first color value based on a first percentage that is generated by dividing the first color value by the third color value.

20. Some embodiments include a subsystem included within a display device for configuring a plurality of pixels to display an image, the subsystem comprising a current module that determines a first current level to be supplied to a first light source based on a first image to be displayed, wherein the first light source illuminates a first screen pixel when supplied with the first current level, a contribution module that determines, based on the first current level, a first color value contributed to the first screen pixel by the first light source when the first light source illuminates the first screen pixel, and a first functional operator that divides the first color value by a second color value associated with a first portion of the first image to generate a first percentage, wherein a display screen included in the display device displays at least part of the first portion of the image based on the first percentage.

Any and all combinations of any of the claim elements recited in any of the claims and/or any elements described in this application, in any fashion, fall within the contemplated scope of the present invention and protection.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine. The instructions, when executed via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable gate arrays.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the preceding is directed to embodiments of the present disclosure, other and further embodiments of the disclosure may be devised without departing from the basic scope thereof, and the scope thereof is determined by the claims that follow.

What is claimed is:

1. A computer-implemented method for configuring a plurality of screen pixels to display an image, the method comprising:

determining a first current level to be supplied to a first light source based on a first image, wherein the first light source is associated with light having a first color value in a color space;

determining a second color value in the color space, wherein the second color value is associated with a first portion of the first image;

determining a first screen pixel responsible for displaying at least part of the first portion of the first image, wherein the first screen pixel is separate from the first light source;

determining, based on the first current level, a first color variation of the first color value in the color space, wherein the first color variation of the first color value is associated with light that is emitted by the first light source in response to the first current level being applied to the first light source, and wherein the first light source emits light having a plurality of different color values in the color space in response to being supplied with a plurality of different current levels; and causing the first screen pixel to compensate for the first color variation of the first color value and a second color variation that is determined based on a second current level applied to a second light source while the first current level is applied to the first light source and to output light having the second color value based on a function of the first color variation of the first color value, the second color variation, and the second color value, wherein the first current level is different from the second current level.

2. The computer-implemented method of claim 1, wherein determining the first current level comprises:

analyzing the first image to determine a target output for the first light source; and mapping the target output to the first current level.

3. The computer-implemented method of claim 1, further comprising generating a first mapping by:

selecting a second screen pixel included in a display screen;

configuring the second screen pixel to transmit received light;

selecting a third light source that is included in the display screen;

selecting a third current level;

supplying the third light source with the third current level to cause the third light source to illuminate the second screen pixel;

obtaining a measurement of a color value associated with light emitted by the second screen pixel when illuminated by the third light source; and generating a map entry that includes the third current level and the measurement of the color value.

4. The computer-implemented method of claim 1, wherein configuring the first screen pixel to output light having the second color value comprises:

evaluating the function of the first color variation of the first color value, the second color variation, and the second color value by dividing a value that depends on the first color variation of the first color value and the second color variation by the second color value to generate a first percentage;

configuring the first screen pixel to filter a first color component of light based on the first percentage; and causing the first light source to illuminate the first screen pixel, wherein the first screen pixel compensates for light contributed by the first light source to the first screen pixel when outputting light having the second color value.

5. The computer-implemented method of claim 4, wherein configuring the first screen pixel to filter the first color component of light comprises adjusting a first valve associated with the first screen pixel based on the first percentage, wherein the first valve controls an amount of red light, green light, or blue light filtered by the first screen pixel.

6. The computer-implemented method of claim 1, wherein determining the second color value associated with the first portion of the first image comprises sampling a red value, green value, or blue value associated with a first pixel that resides within the first portion of the first image.

7. The computer-implemented method of claim 1, wherein the first screen pixel comprises a liquid-crystal display pixel, and the first light source comprises a light-emitting diode.

8. The computer-implemented method of claim 1, further comprising:

determining a first distance between the first light source and the first screen pixel; and evaluating a mapping based on the first distance to determine a third color value, wherein the first light source contributes light having the third color value to the first screen pixel when separated from the first screen pixel by the first distance, wherein the first screen pixel is further configured to output light having the second color value based on a first percentage that is generated by dividing the second color value by the third color value.

9. The computer-implemented method of claim 8, wherein the mapping indicates a plurality of color values and associated luminance values indexed by a plurality of distances.

10. A display device, comprising:

a display screen, including:

a plurality of light sources, and a plurality of screen pixels that emit light when illuminated by the plurality of light sources; and a display controller that causes the display screen to display a first image by performing the steps of:

determining a first current level to be supplied to a first light source based on the first image, wherein the first light source is associated with light having a first color value in a color space, determining a second color value in the color space, wherein the second color value is associated with a first portion of the first image, determining a first screen pixel responsible for displaying at least part of the first portion of the first image, wherein the first screen pixel is separate from the first light source, determining, based on the first current level, a first color variation of the first color value in the color space, wherein the first color variation of the first color value is associated with light that is emitted by the first light source in response to the first current level being applied to the first light source, and wherein the first light source emits light having a plurality of different color values in the color space in response to being supplied with a plurality of different current levels, and causing the first screen pixel to compensate for the first color variation of the first color value and a second color variation that is determined based on a second current level applied to a second light source while the first current level is applied to the first light source and to output light having the second color value based on a function of the first color variation of the first color value, the second color variation, and the second color value, wherein the first current level is different from the second current level.

11. The display device of claim 10, wherein the display controller determines the first current level by: analyzing the first image to determine a target output for the first light source; and mapping the target output to the first current level.

12. The display device of claim 10, wherein a first mapping is generated by:

selecting a second screen pixel included in a display screen;

configuring the second screen pixel to transmit received light;

selecting a third light source that is included in the display screen;

selecting a third current level;

supplying the third light source with the third current level to cause the third light source to illuminate the second screen pixel;

obtaining a measurement of a color value associated with light emitted by the second screen pixel when illuminated by the third light source; and generating a map entry that includes the third current level and the measurement of the color value.

13. The display device of claim 12, wherein a first optical sensor generates the measurement of the color value during a testing procedure.

14. The display device of claim 10, wherein the display controller configures the first screen pixel to output light having the second color value by:

evaluating the function of the first color variation of the first color value, the second color variation, and the second color value by dividing a value that depends on the first color variation of the first color value and the second color variation by the second color value to generate a first percentage;

configuring the first screen pixel to filter a first color component of light based on the first percentage; and causing the first light source to illuminate the first screen pixel, wherein the first screen pixel compensates for light contributed by the first light source to the first screen pixel when outputting light having the second color value.

15. The display device of claim 14, wherein the display controller configuring the first screen pixel to filter the first color component of light comprises adjusting a first valve associated with the first screen pixel based on the first percentage, wherein the first valve controls an amount of red light, green light, or blue light filtered by the first screen pixel.

16. The display device of claim 10, wherein the display controller determines the second color value associated with the first portion of the first image by sampling a red value, green value, or blue value associated with a first pixel that resides within the first portion of the first image.

17. The display device of claim 10, wherein the display controller further performs the steps of:

determining a first distance between the first light source and the first screen pixel; and evaluating a mapping based on the first distance to determine a third color value, wherein the first light source contributes light having the third color value to the first screen pixel when separated from the first screen pixel by the first distance, wherein the first screen pixel is further configured to output light having the second color value based on a first percentage that is generated by dividing the second color value by the third color value.

18. A display controller included within a display device for configuring a plurality of pixels to display an image, the display controller comprising:

a current level generator within the display controller that determines a first current level to be supplied to a first light source based on a first image to be displayed, wherein the first light source illuminates a first screen pixel when supplied with the first current level;

a contribution generator within the display controller that determines a first color value in a color space, wherein the first color value is associated with light that is contributed to the first screen pixel by the first light source when the first light source illuminates the first screen pixel, wherein the first light source emits light having a plurality of different color values in the color space in response to being supplied with a plurality of different current levels; and a first functional operator that divides a value that is based on the first color value by a second color value associated with a first portion of the first image to generate a first percentage, wherein a display screen included in the display device displays at least part of the first portion of the image based on the first percentage.

* * * * *